United States Patent [19]

Bury

[11] Patent Number: 4,686,781

[45] Date of Patent: Aug. 18, 1987

[54] HOLLOWSHOE FOOTWEAR

[76] Inventor: Joseph R. Bury, 3029 54 Avenue North, St. Petersburg, Fla. 33714-2417

[21] Appl. No.: 730,956

[22] Filed: May 6, 1985

[51] Int. Cl.[4] ..... A43B 5/00; A43B 3/12; A63B 23/04

[52] U.S. Cl. ..... 36/132; 36/7.5; 36/11.5; 272/96

[58] Field of Search ..... 36/11.5, 7.5, 132, 136, 36/1, 3 R, 3 B, 29; 272/96, 119; 128/25 B, 582

[56] References Cited

U.S. PATENT DOCUMENTS

| | | | |
|---|---|---|---|
| 660,522 | 10/1900 | Sharood | 36/3 R |
| 1,990,970 | 2/1935 | Wood | 36/132 |
| 2,507,991 | 5/1950 | Neal | 36/136 X |
| 2,599,740 | 6/1952 | Beveridge | 36/11.5 |
| 2,889,639 | 6/1959 | Rudine | 36/11.5 X |
| 3,279,102 | 10/1966 | Seeber, Sr. | 36/7.5 |
| 3,469,576 | 9/1969 | Smith et al. | 128/25 B |

FOREIGN PATENT DOCUMENTS

| | | | |
|---|---|---|---|
| 1485683 | 4/1970 | Fed. Rep. of Germany | 128/582 |
| 910292 | 1/1946 | France | 36/136 |
| 2278281 | 2/1976 | France | 36/132 |
| 52-43535 | 4/1977 | Japan | 36/11.5 |
| 2100969 | 1/1983 | United Kingdom | 36/132 |

*Primary Examiner*—James Kee Chi

[57] ABSTRACT

A weighted hollowshoe footwear comprises rubber top, bottom, and sides. An inner chamber is formed by said rubber top, bottom, and sides. A central rubber spine having an inverted V-shape tip is provided in said inner chamber to allow integral weighting material to migrate within said inner chamber.

1 Claim, 3 Drawing Figures

HOLLOWSHOE FOOTWEAR

Figure 1:
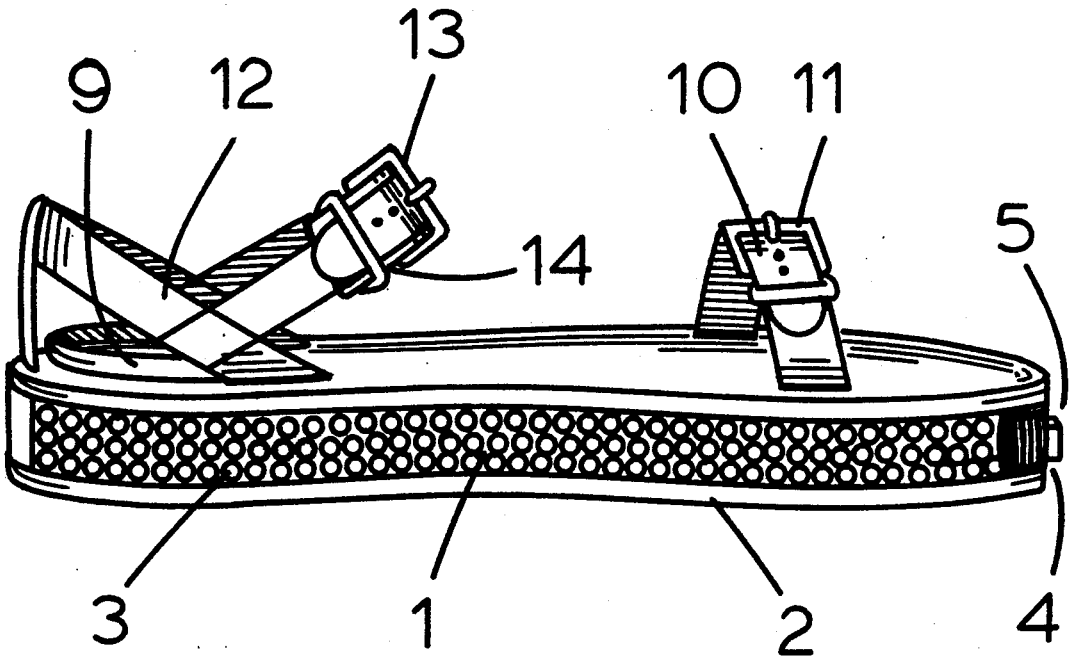

This invention is literally hollowshoe footwear and is more particularly a molded, spherical lead-filled or similarly weighted, durably soft rubber sandal thats used to healthfully enhance walking.

Before hollowshoe, all leg or foot weights known either restricted the wearer to walking on a heavily padded mat, or to a seated position because they were solid, even brassily inflexible metal, or had restrictive barbell attachments or were otherwise affixed unstably above the ground contact axis of the human foot, instead of softly but firmly below it as in hollowshoe footwear. It's the crafted purpose of hollowshoe that once in motion, it becomes a naturally non-restrictive, flexible, and unusually satisfying pendular extension of the wearers foot and bodily equillibrium. It's effect is almost addictively gyroscopic. As an intent of invention, one does not in essence have to be an artificer of brass or other metals, nor have any special skills at all to expertly, and healthfully use, and gain personal muscular, and cardio-pulmonary benefits from hollowshoe footwear.

Accordingly, it is an object of the present invention to provide a superiorly unprecedented, inexpensively healthfull means of exercise with footwear weights for the public at large.

It is a further object of the invention to initially provide hollowshoe footwear in sandal form that can safely contain lead, and excell in the healthfull practicality and weighted use of this containment on any walkable surface indoors or out by being quickly strappable to a wearers existant footwear.

It is a still further object of the invention to provide a removeable metal screw plug in it's vertical front by which not only lead, but near any weight producing material desired may be easily introduced, or removed by anyone using hollowshoe footwear, and that the hollowshoe in unfilled form can even lend itself—where necessary or suitable—as a survival, or technologically microprocessed store/carry, or containment medium among a civilian, scientific, or military populace.

With the above and other objects in view as will hereinafter appear. It can be realized that the hollowshoe invention by it's nature alone contemplates multiple use.

Reference is made to the accompanying drawings in which there is shown an illustrative embodiment of the invention from which it's unique features, practicalities, and advantages will be apparent.

In the drawings:

FIG. 1 is a cut-away overall perspective view of the flat-soled, rubber molded hollowshoe sandal interior. It is filled with spherical lead, and the hollow space in itself embody's one form of the invention as footwear into which weight—by a wearer—may be instantly, and unnoticeably added or subtracted through a molded in place screw-plug opening secured with, a metal screw plug. The front and rear leather straps, steel buckles, and rear strap padding, and horseshoe shaped molded heel retaining ridge may also be seen.

Figure 2:
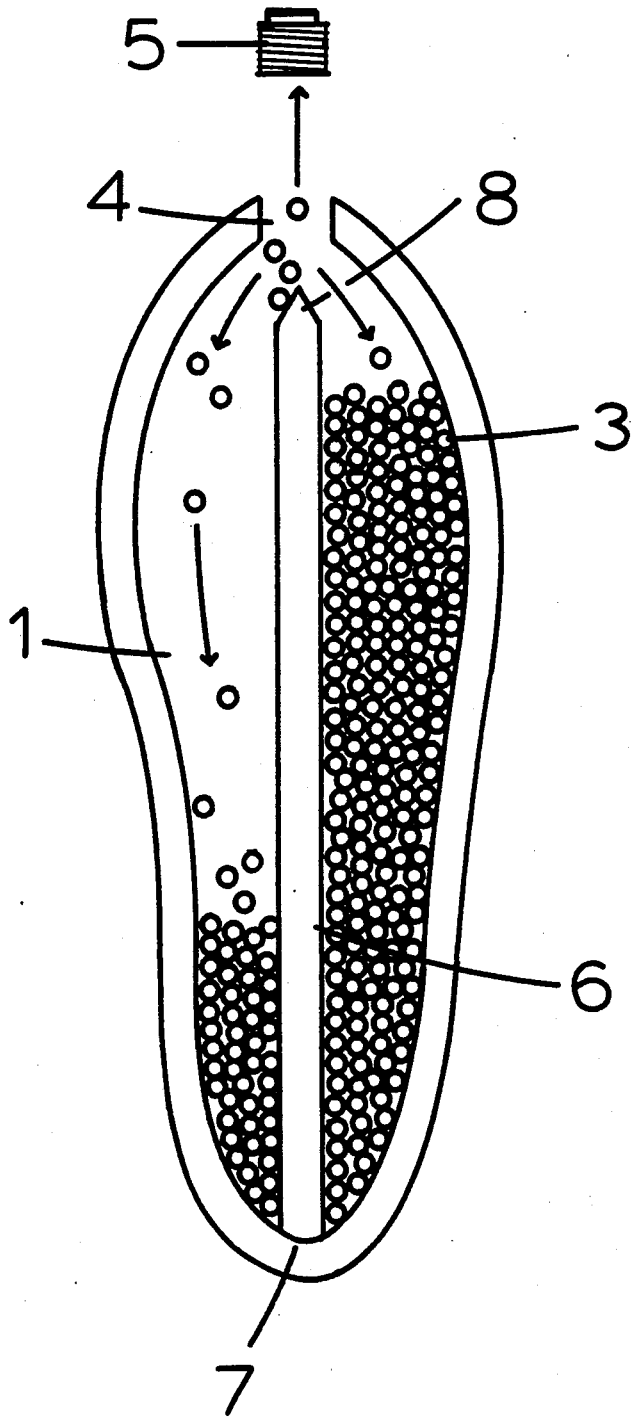

FIG. 2 is a cut-away view of the lead in FIG. 1 and emphasizes the removeable screw plug in the vertical hollowshoe front, and the lead sphericals pouring, and diverging into two separate, yet commonly accessible chambers divided by an integrally molded-V-tipped supporting spine which along it's full length joins the top, bottom, and heel structures.

Figure 3:
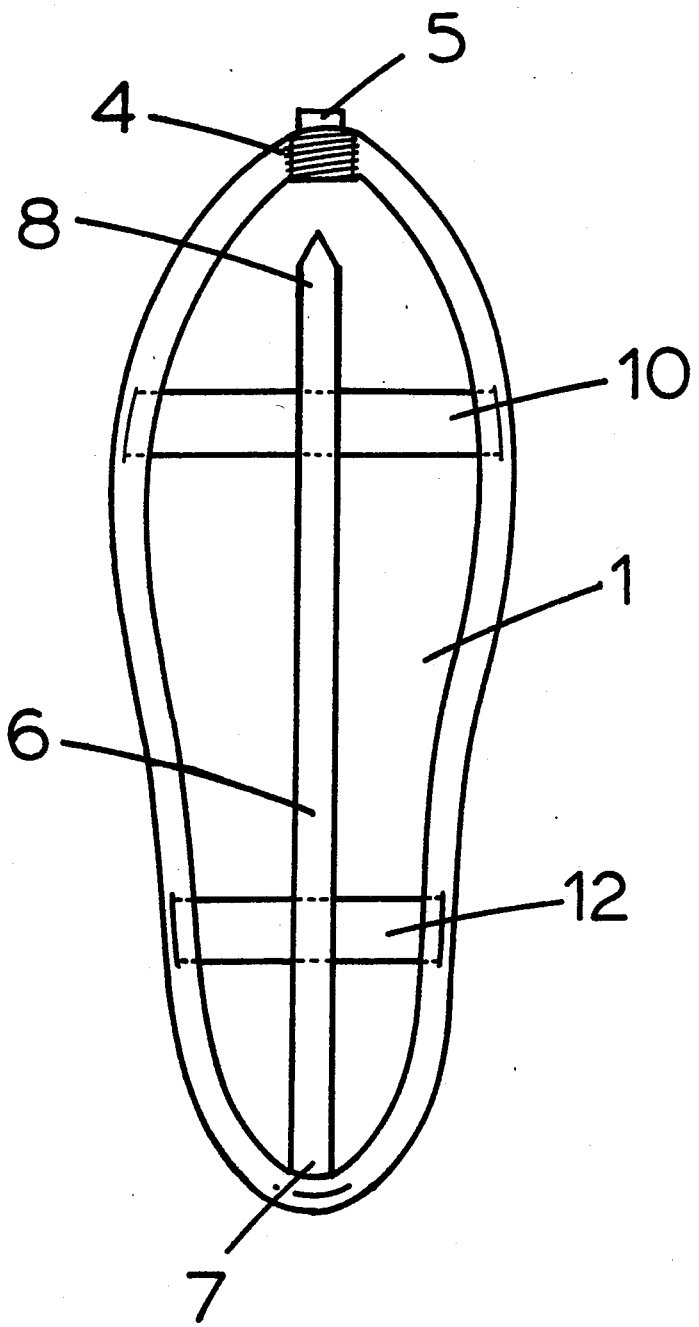

FIG. 3 is a similar view as in FIG. 2 but is minus all lead and emphasizes the proximity of the integral-V-tipped spine to the now fully seated metal screw plug and the interior placement of the one piece front and rear leather straps molded into the bottom interior of the hollowshoe, and as seen in FIG. 1, the two points in the front, and three points in the rear at which they exit the top of the hollowshoe to strongly encircle the wearer's foot.

Referring to FIGS. 1 to 3, it may be seen that the illustrative hollowshoe sandal 2, 6, 7, 8, 10, and 12 is of molded rubber construction throughout and that exclusive of leather straps 10–12. steelBuckles 11–13. Padding, 14. And a metal screw plug 5. The hollowshoe sandal is plain in appearance with it's only basically apparent design distinguishment being a horseshoe shaped ridge 9 on it's top rear. The purpose of which is to prevent a wearers existant footwear from slippage on the hollowshoe which, in sandal form is made to supplement footwear rather than replace it. The hollowshoe space-1—is, in FIG.-1—filled with spherical lead with the metal screw plug 5 fully seated in the screw plug opening 4.

In FIG. 2, the spherical lead 3 is shown automatically diverging past a rubber spine 6, 7, 8, that at it's tip 8 is V-shaped, and apart enough from the opening 4 that the hollow space itself-1-still forms one common chamber in which the lead will slowly migrate back and forth while the spine 6, 7, 8, minimizes compression and deformation of the lead as the hollowshoe is trod upon. FIGS. 2–3 show the screw plug in both an unseated, and seated position relative to the opening 4.

FIG. 3 shows the hollowshoe devoid of all lead so that the molded in place leather straps 10–12 may be shown in their positions directly under the load bearing spine 6, 7, 8. In hollowshoe this placement is an imperative for maximal strength and utility, and in more-or-less form would relatively apply to any conventional footwear superstructure built upon hollowshoe because of the weight/torsional stresses involved.

Referring to FIG. 3 is where the amount of interior space-1- claimed by the hollowshoe configuration in relationship to the screw-plug 5 and the V-tip 8 best shows itself. And it is here apparent—as in FIG. 2—that the hollowshoe could easily store and carry small survival items based on individual preferences or imagined needs, as well as a near infinite list of molded in place, varianced, micro-processed scientific instrumentations. Not the least of which could be transduced, or hybrid transduced uses making the most humble, or unskilled hollowshoe wearer an intelligence gatherer—when so employed—if not ultimately an indirect benefactor to the pool of human knowledge. These last are alternative, and creative uses, but well within the capable probabilities of the invention since history shows that leg, and foot power have always been harnessed where necessary. Without precedent, the hollowshoe invention simply refines, and tangibly raises this fact into the realm of the energy seeking present, and future.

Since obvious changes may be made in the illustrated hollowshoe without departing from the scope of it's invention. It's intended that all matters contained herein be interpreted in an illustrative, and not a limiting sense.

Having thus described my invention. What I claim as new, and desire to secure by letters patent of the United States is:

1. A weighted hollowshoe footwear comprising (a) rubber top, bottom, and sides, (b) an inner chamber formed by said rubber top, bottom, and sides;

(c) a central rubber spline having an inverted V-shape tip at one end for allowing integral weighting material to migrate within said inner chamber, (d) said central rubber spline being made integral with said hollowshoe footwear, (e) a closure opening located at the front of said sides, and (f) a means for closing said closure opening.

* * * * *